United States Patent [19]
Hofmann
[11] 4,339,911
[45] Jul. 20, 1982

[54] OPEN-END SPINNING ROTOR CONSISTING OF A BASIC MEMBER AND A ROTOR MEMBER

[75] Inventor: Eberhard Hofmann, Ingolstadt, Fed. Rep. of Germany

[73] Assignee: Schubert & Salzer, Ingolstadt, Fed. Rep. of Germany

[21] Appl. No.: 188,219

[22] Filed: Sep. 17, 1980

[30] Foreign Application Priority Data

Sep. 28, 1979 [DE] Fed. Rep. of Germany ..... 2939325

[51] Int. Cl.[3] ..... D01H 1/135; D01H 7/882
[52] U.S. Cl. ..... 57/416
[58] Field of Search ..... 57/58.89

[56] References Cited

U.S. PATENT DOCUMENTS 3,439,487 4/1969 Landwchrkamp et al. ..... 57/58.89
3,796,034 3/1974 Grau ..... 57/58.89 X
3,943,691 3/1976 Mizon et al. ..... 57/58.89
4,016,713 4/1977 Läuger et al. ..... 57/58.89 X
4,179,874 12/1979 Jacobsen ..... 57/58.89

FOREIGN PATENT DOCUMENTS 2358479 3/1978 France ..... 57/58.89

*Primary Examiner*—Donald Watkins
*Attorney, Agent, or Firm*—Dority & Flint

[57] ABSTRACT

An open-end spinning rotor (2) consisting of a basic member (8) and a rotor member (9). The basic member is carried by a bearing and drive element (81, 82, 83) and comprises a substantially radial supporting surface (80) with a centering surface (31) at its outer edge, with which a centering surface (40) of the rotor member (9) co-operates. A connecting element (5) which affords a detachable connection between basic member (8) and rotor member (9) is disposed separately from the centering surfaces (31, 40).

11 Claims, 3 Drawing Figures

OPEN-END SPINNING ROTOR CONSISTING OF A BASIC MEMBER AND A ROTOR MEMBER

BACKGROUND OF THE INVENTION

The present invention relates to an open-end spinning rotor consisting of a basic member and a rotor member. The basic member is carried by a bearing-drive element and comprises a substantially radial supporting surface with a centering surface at its outer edge, with which a centering surface of the rotor member co-operates. The rotor member has a fiber collecting surface therein.

The part of the spinning rotor which comes into contact with the fibers to be spun is subject to considerable wear so that a replacement of the spinning rotor is necessary after a certain number of working hours. Although it is known to construct a spinning rotor of a plurality of parts, hitherto the whole unit forming the spinning rotor has always had to be replaced. Thus, a basic member is pressed onto a drive spindle and into a rotor member, for example, so that drive spindle, basic member and rotor member can no longer be separated from one another (DEOS No. 2.058.340).

It has already been proposed, however, to provide only an easy press fit between a cylindrical basic member and a rotor member constructed in the form of an insert (DE-OS No. 2.130.582). With industrial mass production, the necessary precise tolerances cannot easily be adhered to. On the one hand there is the risk that the pressing is so great that on replacement of the rotor member, the basic member is also abraded and as a result too much play develops which, in time, does not insure secure holding of the rotor member in the basic member. On the other hand, there is the risk that the play between the rotor member and basic member is too great from the beginning so that the rotor member is not securely held in the basic member. Moreover, since the basic member extends over the whole axial extent of the rotor member, this leads to an increase in the weight of the spinning rotor, so that a higher drive power is necessary.

SUMMARY OF THE INVENTION

It is therefore the object of the present invention to provide a composite spinning rotor which, on the one hand renders possible easy replacement only of the part subject to wear and on the other hand renders possible relatively great tolerances and which furthermore does not lead to any substantial increase in the weight of the spinning rotor.

According to the invention, this problem is solved in that a connecting element affording a detachable connection between basic member and rotor member is disposed separately from the centering surfaces of basic member and rotor member. Since the centering surfaces only serve the purpose of centering and not of securing a simple adaptation of the centering surfaces to their purpose and of the connecting element to its purpose is possible, without excessive demands having to be made on tolerances. As a result, there is no risk of damage or wear of the basic member, so that the basic member has a long life. This is particularly important because the basic member generally forms a structural unit with the bearing and the drive.

In order to avoid pinching of fibers between rotor member and basic member, according to a further feature of the invention, the rotor member comprises, at its end adjacent to the basic member, a bottom which is parallel to the supporting surface and which at least partially covers the basic member.

In a spinning apparatus in which the spinning rotor is covered by a cover which comprises an attachment projecting into the open end of the spinning rotor, through the generated surface of which a fiber feed passage leads to the fiber sliding surface the bottom of the rotor member is preferably annular and reaches radially inwards at least as far as the cylinder surface laid through the mouth of the fiber feed passage. In this case, the supporting surface of the basic member may advantageously comprise a concentric projection which projects into the annular rotor member and projects axially above the bottom.

The solution according to the invention is not only suitable for replacement of the rotor member in the event of wear, but can also be used if the fiber material to be spun is changed and a spinning rotor with another internal diameter is needed. For this purpose, according to the invention, the rotor member comprises an internal and external diameter adapted to the fiber material and the centering surface of the basic member has a diameter corresponding to the maximum external diameter of the rotor member provided, independently of the fiber material, and according to the diameter of the rotor member, this comprises a flange extending outwards parallel to the supporting surface of the basic member with a centering surface at its outer periphery. The centering surface of the rotor member is always the same size. However, with a maximum diameter of the rotor member, the centering surface is directly at the outer periphery of the rotor and with a smaller diameter of the rotor member is on the flange. The surface of the flange adjacent to the supporting surface can serve for the securing.

In order to exchange the rotor member for another with a different internal diameter, however, the centering surfaces can also be disposed in the region between the connecting element and the peripheral surface with the largest external diameter of the rotor member.

It is advisable for the rotor member to be constructed in the form of a cheap throw-away part which is not only economical to produce but also needs little energy for its drive. For this purpose, according to a further feature of the invention, the rotor member is formed by a sheet-metal part shaped without cutting. In this case, the rotor member is produced from a flat or cylindrical sheet metal part by the deep-drawing and/or pressed metal process.

The securing of the rotor member to the basic member can be effected in various ways. A band, which has adhesive on both sides can be inserted between the supporting surface of the basic member and the bottom of the rotor member for securing the rotor to the basic member. In order to cancel the adhesive connection between basic member and rotor member if necessary, for example in order to exchange the rotor member, it is sufficient to lay the unit in an acetate bath so that the band is within the range of action of the bath and the adhesive dissolves.

According to a further embodiment of the invention, the rotor member is connected to the basic member by means of a detent connection, or the connecting element between rotor member and basic member is a shrunk-on flexible tube surrounding the rotor member and the basic member in the region of their centering surfaces.

The construction designed to carry out the invention will be hereinafter described, together with other features thereof.

The invention will be more readily understood from a reading of the following specification and by reference to the accompanying drawings forming a part thereof, wherein an example of the invention is shown and wherein:

DESCRIPTION OF A PREFERRED EMBODIMENT

Figure 1:
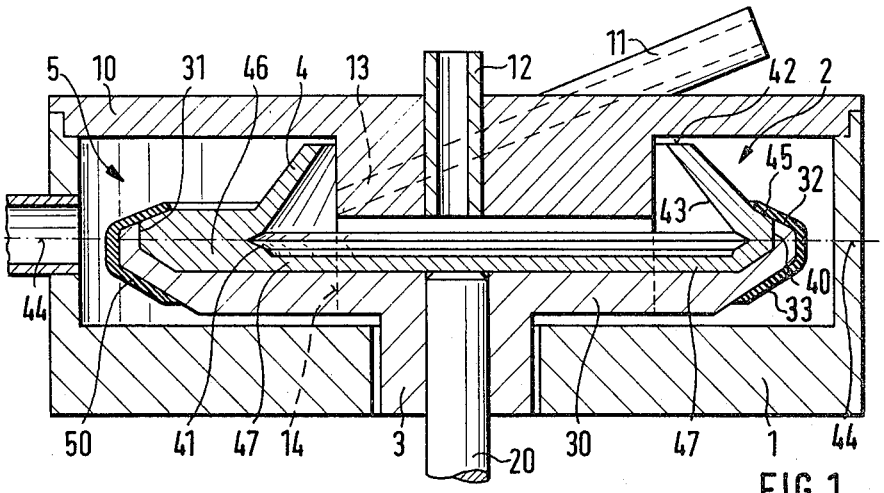
FIG. 1 shows, in longitudinal section, an open-end spinning rotor constructed according to the invention, the rotor member of which is secured to the basic member by means of a shrunk-on flexible tube, the securing of a small rotor member being illustrated on the left and the securing of a larger rotor member to a basic member which is always the same size being illustrated on the right.

According to FIG. 1, in a housing 1 which is closed by a cover 10 there is an open-end spinning rotor 2 which is disposed on the end of a shaft 20 which extends through the bottom of the housing 1 and is journaled and driven in known manner. Thus, the shaft 20 forms the bearing and drive element of the open-end spinning rotor 2.

The open-end spinning rotor 2 comprises a basic member 3 and a rotor member 4 which are connected to one another by a connecting element 5 affording a detachable connection. The basic member 3 is carried by the bearing and drive element formed by the shaft 20 and comprises a substantially radial supporting surface 30 with a centering surface 31 constructed in the form of an internal periphery surface, at its outer edge, which extends in the axial direction. The rotor member 4 likewise comprises a centering surface 40 at its outer periphery, which co-operates with the centering surface 31 of the basic member 3. The rotor member 4 further comprises a collecting surface 41 which may be constructed in known manner as a concave groove or channel, an open edge 42 at the end remote from the basic member 3 and a fiber sliding surface 43 between its open edge 42 and the collecting surface 41.

A fiber feed passage 11 disposed in the cover 10 leads to the fiber sliding surface 43 in known manner. Also disposed in the cover 10, coaxially to the open-end spinning rotor 2, is a thread withdrawal tube 12 through which the thread is withdrawn by means of rollers not shown, having been formed by the rotation of the open-end spinning rotor 2 from the fibers fed into the open-end spinning rotor 2 through the fiber feed passage 11.

The centering surface 40 of the rotor member 4 is at the position where the rotor member 4 has the largest periphery, that is to say in the region of the plane 44 extending through the collecting surface 41 of the rotor member 4. At each side of this plane 44, both the rotor member 4 and the basic member 3 comprise external surfaces 45 or 32 and 33 which become narrower in a taper. The rotor member 4 and the basic member 3 are surrounded, at their outer periphery, in the region of the outer surfaces 45, 32 and 33, by a shrunk-on flexible tube 50 which serves as a connecting element 5 between basic member 3 and rotor member 4.

Thus, the connection between the basic member 3 and the rotor member 4 is effected separately from the centering surfaces 31 and 40 which only have to fulfill the purpose of centering and not also the purpose of securing. As a result, the centering surfaces 31 and 40 on the basic member 3 and on the rotor member 4 can be produced without difficulty. The connecting element 5 is also easy to produce because it is a question of an ordinary commercial shrunk-on flexible tube which, after being pulled over the open-end spinning rotor 2, shrinks to about 30% of its original size and therefore holds the basic member 3 and the rotor member 4 firmly together.

The rotor member 4 may have various sections, surfaces and internal diameter. On a change of material or after wear, it is easily possible to exchange the rotor member 4 independently of the basic member 3. For this purpose, the shrunk-on flexible tube 50 merely has to be broken open and, after exchange of the rotor member 4, a new heated shrunk-on flexible tube 50 fitted, which can be carried out without difficulty. As a result of cooling, the shrunk-on flexible tube contracts and so causes the firm connection between basic member 3 and rotor member 4.

If another length of fiber has to be spun, then another rotor diameter and a correspondingly adapted cover 10 is necessary. In order not to have to exchange the whole open-end spinning rotor 2, for which purpose the basic members 3 would also have to be kept in store, the rotor members 4 can have a uniform external diameter for their centering surfaces 40 even if the diameter of the collecting surface 41 varies. For this purpose, the smaller rotor members 4 comprise a flange 46 extending outwards parallel to the supporting surface 30 of the basic member 3, as shown in the left-hand side of FIG. 1, which flange comprises the centering surface 40 at its outer periphery.

The basic member 3 is adapted in its dimensions to the largest rotor member 4 in question, which does not comprise such a flange 46 but the outer periphery of which is equipped directly with the centering surface 40. Thus, only the smaller rotor members 4 comprise a flange 46 of different size according to the diameter of their collecting surface 41, at the outer periphery of which flange the centering surface 40, which is always the same size, is disposed. In this manner the stocking is restricted only to the different sizes of rotor members 4.

In order to prevent fibers from being pinched between the rotor member 4 and the basic member 3 and remaining there, the rotor member 4 comprises, preferably at its end adjacent to the basic member 3, a bottom 47 which is parallel to the supporting surface 30 and which at least partially covers the supporting surface 30. In the embodiment shown in FIG. 1, the bottom 47 of the rotor member 4 is of annular construction in order to keep the mass of the rotor member 4 as small as possible. The bottom 47 reaches radially inwards as far as the cylinder surface 14 laid through the mouth 13 of the fiber feed passage 11.

Figure 2:
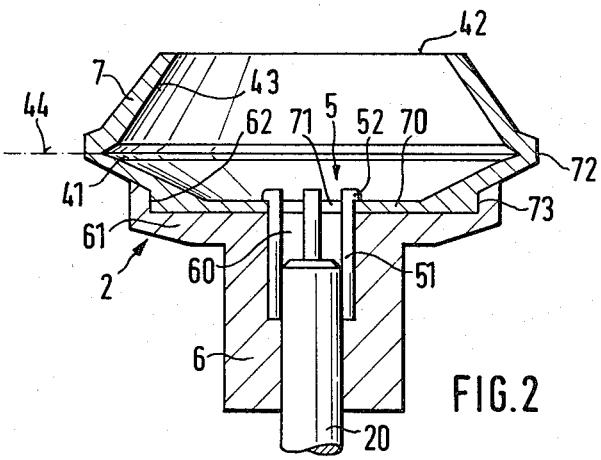
FIG. 2 shows, in longitudinal section, a modification of the invention wherein the rotor member is connected to the basic member by means of a detent connection.

FIG. 2 shows an embodiment of the open-end spinning rotor according to the invention wherein detents 51 disposed annularly serve as a connecting element 5 between basic member 6 and rotor member 7. These detents 51 are disposed in the bore 60 of the basic member 6 receiving the shaft 20 and are supported by the shaft 20 at their end remote from the rotor member 7. The end adjacent to the rotor member 7 is no longer supported by the shaft 20 and so can yield inwards to a radial pressure. At their outside, the detents 51 comprise a small nose 52 with which they can engage over the bottom 70 of the rotor member 7. The bottom 70 of the rotor member 7 comprises a central bore 71 which is precisely the same size as the bore 60 in the basic member 6 and permits the passage of the detents 51. While the rotor member 7 is being pushed over the basic member 6, the detents 51 spring radially inwards and snap radially outwards again when the rotor member 7 comes to bear against the supporting surface 61 of the basic member, so that a detent connection is afforded between rotor member 7 and the basic member 6. The removal of the rotor member 7 from the basic member 6 is effected by pulling action, likewise in a simple manner, so that an exchange of the rotor member can easily be carried out.

The centering surfaces can be constructed in the same manner as shown in FIG. 1. In this case, a shrunk-on flexible tube as shown in FIG. 1 may also be provided as a second, additional connecting element.

It is also possible, however, to dispose the cylindrical centering surfaces 73 and 62 not at the position of the peripheral surface 72 with the largest outside diameter of the rotor member 7, but at a position of the rotor member 7 at the side adjacent to the basic member between the connecting element 5 and the said peripheral surface 72 with the largest external diameter. Furthermore, it is possible to provide both centering surfaces 31 and 40 as shown in FIG. 1 and centering surfaces 62 and 73 as shown in FIG. 2, in combination.

Figure 3:
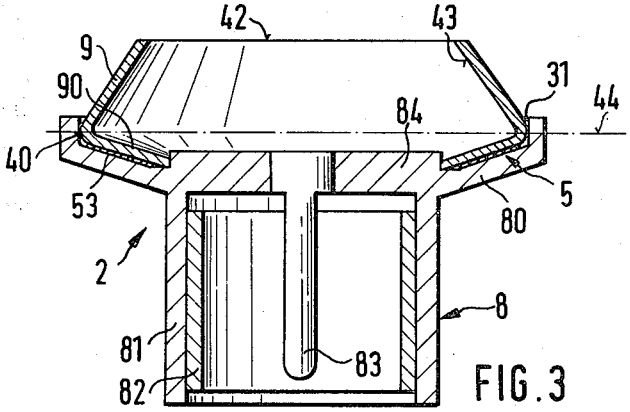
FIG. 3 shows, in longitudinal section, a further embodiment of the spinning rotor according to the invention, wherein the rotor member is secured to the basic member by means of a band which is adhesive at both sides.

A band 53, which is adhesive on both sides, can also be used as a connecting element 5, which is between the supporting surface 80 of the basic member 8 and the bottom 90 of the rotor member 9. The supporting surface may then extend precisely radially in one plane (see supporting surfaces 30 and 61 (FIGS. 1 and 2) or be constructed as inclined annular surfaces (see supporting surfaces 80, FIG. 3).

Even when a band 53 which is adhesive on both sides is used as a connecting element, an exchange of the rotor member 9 can be carried out in that the adhesive is dissolved in an acetate bath. The securing of the new rotor member 9 is then effected by sticking in by means of a new band 53 which is adhesive on both sides.

An adhesive band 53 can also be used in combination with a shrunk-on flexible tube as shown in FIG. 1 or with a detent connection as shown in FIG. 2.

In all the embodiments described according to the present invention, the connecting element 5 is separate from the centering surfaces 31, 40 or 62, 73 so that these only have to fulfill the purpose of centering, while the connecting element 5 only serves for the connection of rotor member and basic member. Both the centering surfaces and the connecting element or the connecting elements can thus be adapted to their purpose in an optimum manner.

The rotor member 4 or 7 in FIGS. 1 and 2 is produced by cutting manufacture. In order to obtain a rotor member 9 of particularly small mass, it can be constructed from a sheet-metal and shaped without cutting, in accordance with FIG. 3.

The construction of the bearing and drive element is also immaterial for the present invention. Thus, instead of the basic member being connected to a shaft 20, the basic member 8 may be made in one piece with a sleeve 81 which carries permanent magnets 82 at its inner wall which, in turn, are part of an electric motor. A pivot pin 83 carried by the supporting surface 80 is provided concentrically in the sleeve 81 for the bearing arrangement.

In order to avoid the wedging of fibers between rotor member 4 or 9 and basic member 3 or 8, the supporting surface 30 or 80 may comprise a concentric projection 84 which projects into the annular rotor member 4 or 9 and projects axially above the bottom 47 or 90. If desired, this projection 84 can even project into the course of the thread between collecting surface 41 and thread withdrawal tube 12, so that the thread being withdrawn rolls on the projection 84.

The construction in the form of a composite rotor with a basic member 3 which is always the same size and rotor members 4 of different sizes which are adapted to the basic member 3 by a flange 46 can be used independently of the special type of connection between basic member 3 and rotor member 4. Other kinds of securing, not explained, can be used in this connection.

The above description shows that the subject of the invention can be modified in many ways. Further modifications are possible by exchanging features for equivalents or by combinations of features.

What is claimed is:

1. An open-end spinning rotor including a basic member and a rotor member, said basic member being carried by a bearing and drive element and has a substantially radial supporting surface with a centering surface at its outer edge, said rotor member which includes a collecting surface has a centering surface which cooperates with said centering surface of said basic member comprising:

a connecting element means (5) engaging said rotor member and said basic member providing a detachable connection between said basic member (3,6, 8) and said rotor member (4, 7, 9);

said connecting element means being separated from the centering surfaces of said basic member and rotor member.

2. A spinning rotor as claimed in claim 1 further comprising:

said rotor member (4, 7, 9) including at its end adjacent to the basic member (3, 6, 8), a bottom (47, 70, 90) which is parallel to said supporting surface (30, 61, 80) and at least partially covers said supporting surface.

3. A spinning rotor as set forth in claim 2, which is covered by a cover which comprises a cylindrical member which projects into the open end of the spinning rotor and through which a fiber feed passage leads to a fiber sliding surface of said rotor member, comprising:

said bottom (47, 70, 90) of said rotor member (4, 7, 9) being annular and reaches radially inwards at least as far as the surface of said cylindrical member (14) situated through the mouth (13) of the fiber feed passage (11).

4. A spinning rotor as claimed in claim 2 further comprising:

said supporting surface (80) of the basic member (8) includes a concentric projection (84) which projects into said rotor member (9) and projects axially above said bottom (90) of said rotor member.

5. A spinning rotor as claimed in claim 1 further comprising:

said centering surfaces (62, 73) being disposed in a region between said connecting element means (5) and an outer surface (72) of said rotor member (7).

6. A spinning rotor as claimed in claim 1 further comprising:

said rotor member (9) is a sheet-metal part shaped without cutting.

7. A spinning rotor as claimed in claim 2 further comprising:

said connecting element means including a band (53) which is adhesive on both sides, said band being carried between said supporting surface (80) of said basic member (8) and said bottom (90) of the rotor member (9).

8. A spinning rotor as claimed in claim 1 further comprising:

said connecting element means including detent connections (51, 52) connecting said rotor member (7) to said basic member (6).

9. A spinning rotor as claimed in claim 1 further comprising:

said connecting means comprising a shrunk-on flexible tube surrounding said rotor member and said basic member in the region of their centering surfaces.

10. A spinning rotor as claimed in claim 1 further comprising:

said rotor member comprising an internal and external diameter adapted to the fiber material;

said centering surface of the basic member having a diameter corresponding to the maximum diameter of the rotor member provided, independently of the fiber material, and according to the diameter of the rotor member, said centering surface of said rotor comprising: a flange extending outwards parallel to the supporting surface of the basic member with a centering surface at its outer periphery.

11. An open-end spinning rotor including a basic member and a rotor member, said basic member being carried by a bearing and drive element and has a substantially radial supporting surface with a centering surface at its outer edge, said rotor member which includes a collecting surface has a centering surface which cooperates with said centering surface of said basic member comprising:

said rotor member comprising an internal and external diameter adapted to the fiber material;

said centering surface of the basic member having a diameter corresponding to the maximum diameter of the rotor member provided, independently of the fiber material, and according to the diameter of the rotor member, said centering surface of said rotor comprising: a flange extending outwards parallel to the supporting surface of the basic member with a centering surface at its outer periphery.

* * * * *